US005788178A

United States Patent [19]

Barrett, Jr.

[11] Patent Number: 5,788,178

[45] Date of Patent: Aug. 4, 1998

[54] GUIDED BULLET

[76] Inventor: Rolin F. Barrett, Jr., 4001 George V. Strong Wynd, Raleigh, N.C. 27612

[21] Appl. No.: 888,425

[22] Filed: Jul. 7, 1997

Related U.S. Application Data

[63] Continuation-in-part of Ser. No. 660,700, Jun. 5, 1996, abandoned.

[60] Provisional application No. 60/002,608 Jun. 8, 1995.

[51] Int. Cl.[6] ..... F41G 7/22

[52] U.S. Cl. ..... 244/3.11; 244/3.21; 244/3.24; 102/501

[58] Field of Search ..... 244/3.11, 3.13, 244/3.15, 3.16, 3.21, 3.24; 102/293, 501

[56] References Cited

U.S. PATENT DOCUMENTS

| | | | |
|---|---|---|---|
| 46,490 | 2/1865 | Orwig . | |
| 412,670 | 10/1889 | Ross . | |
| 1,243,542 | 10/1917 | Moore . | |
| 1,277,942 | 9/1918 | Kaylor . | |
| 3,125,313 | 3/1964 | Sodererg | 244/3.21 |
| 3,282,540 | 11/1966 | Lipinski . | |
| 3,860,199 | 1/1975 | Dunne . | |
| 3,977,629 | 8/1976 | Tubeuf . | |
| 4,176,814 | 12/1979 | Albrektsson et al. | 244/3.15 |
| 4,407,465 | 10/1983 | Meyerhoff | 244/3.16 |
| 4,431,150 | 2/1984 | Epperson, Jr. . | |
| 4,537,371 | 8/1985 | Lawhorn et al. . | |
| 4,648,567 | 3/1987 | Maudal et al. | 244/3.24 |
| 4,711,152 | 12/1987 | Fortunko . | |
| 4,893,815 | 1/1990 | Rowan . | |
| 4,899,956 | 2/1990 | King et al. | 244/3.21 |
| 4,965,453 | 10/1990 | Hoschette et al. | 250/349 |
| 5,014,621 | 5/1991 | Fox et al. | 102/213 |
| 5,280,751 | 1/1994 | Muirhead et al. | 102/210 |
| 5,282,588 | 2/1994 | August | 244/3.3 |
| 5,381,445 | 1/1995 | Hershey et al. | 375/1 |
| 5,419,982 | 5/1995 | Tura et al. | 429/162 |
| 5,425,514 | 6/1995 | Grosso | 244/3.22 |
| 5,455,587 | 10/1995 | Schneider | 342/62 |
| 5,529,458 | 6/1996 | Humpherson | 416/20 R |
| 5,662,291 | 9/1997 | Sepp et al. | 244/3.13 |

OTHER PUBLICATIONS

Definition of "Bullet" from Fundamental of Small Arms, U.S. Army Ordnance Center and School, Oct. 1988.

*Primary Examiner*—Charles T. Jordan
*Assistant Examiner*—Christopher K. Montgomery
*Attorney, Agent, or Firm*—Mills Law Firm PLLC

[57] ABSTRACT

A small caliber laser-guided bullet having a self-contained guidance system is disclosed including on-board laser sensors and navigational circuits capable of detecting a laser target signature, determining the deviation of the bullet from an optimum projectory along which the bullet would impact a hostile target, and generating an electrical signal to piezo electric steering control surfaces to effect a change in the course of the bullet. The guided bullet utilizes a plurality of symmetrically-arranged laser sensor elements which are positioned about a longitudinal axis of the bullet. The laser sensor elements function to transmit optical radiation from the laser target beam to photo detector elements housed within the bullet. The electrical signals from the photo detector elements are then amplified and processed by semiconductor logic circuits to produce the functions required by the steering control surfaces to translate the bullet to the optimum trajectory. Electrical power for the guidance system is provided by a miniature lithium-polymer battery which is interconnected with the navigational circuits to produce the functions of the system. The guided bullet is fired from a precision, smooth bore weapon using a conventional expanding gas cartridge and is effective at ranges up to 3,000 meters and beyond.

16 Claims, 11 Drawing Sheets

GUIDED BULLET

This application is a continuation-in-part of application Ser. No. 08/660,700, filed Jun. 5, 1996, now abandoned.

SPECIFICATION

This application claims the benefit of U.S. Provisional Application No. 60/002,608 filed Jun. 8, 1995 by Rolin F. Barrett, Jr. for Guided Bullet.

BACKGROUND OF INVENTION

1. Field of Invention

This invention relates generally to guided projectiles and, more particularly, to a self-contained laser guided system capable of maneuvering an in-flight, small caliber bullet to a designated target.

With the end of the Cold War, the nature of the threat to American interests has changed from a clash of super powers to multiple, low intensity conflicts fueled by regional and intranational differences. The demands of avoiding non-combatant causalities, placed on an army engaged in low intensity conflict, has led to the development of precision munitions and/or so-called SMART munitions.

Many guidance systems have been proposed for use with missiles and projectiles. In the case of projectiles, the majority of such guidance systems are useful only for larger calibers and are not compatible with precision rifle fire at the level of performance expected of a sniper.

Sniper rifle performance has been expressed as the smallest angle from the sniper rifle muzzle into which all of the shots from a rifle can be fired. The performance of a sniper rifle has usually been expressed in minutes of angle.

Some of the current precision rifles have placed all of their shots into a circle subtending a quarter of a minute of angle if the human operator was capable of his part in this performance.

Despite the high level of performance offered by current precision sniper rifles, the full potential of these rifles is rarely utilized due to the human limitations of the sniper operator. Under normal conditions a typical sniper operator can achieve one minute of angle. Under adverse conditions the typical sniper operator may only achieve two to three minutes of angle. Thus, efforts to improve sniper equipment using conventional unguided bullets are beginning to reach a point of diminishing returns.

The present invention has been developed to provide a laser guided bullet adapted for long range, precision fire by sniper trained personnel. The guided projectile of the present invention includes a self-contained guidance mechanism that is capable of guiding an in-flight bullet along an optimum trajectory to a laser designated target.

2. Description of Related Art

U.S. Pat. No. 46,490 to Thomas G. Orwig discloses a small caliber projectile that includes a telescopic stem provided with wings wherein the stem elongates by its own inertia after the projectile leaves the muzzle of a barrel of the firing weapon increasing the range, velocity, and force, and also the certainty of striking the object fired at.

U.S. Pat. No. 1,277,942 to John M. Kaylor discloses a projectile with sustaining wings and a stabilizing fin tending the hold the projectile to a direct forward course during its flight and prevent lateral canting or turning thereof.

U.S. Pat. No. 412,670 to George B. Ross discloses a projectile having two or more turbine wings which are deployed at the moment the projectile leaves the gun for the purpose of causing its rotation during flight thereby increasing its range and accuracy.

U.S. Pat. No. 3,977,629 to Jean Tubeuf discloses a projectile guidance system which employs entry and exit ports for an ambient fluid medium with fluidic circuits interconnecting various of the entry and exit ports so that asymmetry of the flow through the ports induces the desired yawing torque on the projectile.

U.S. Pat. No. 3,860,199 to Brian B. Dunne discloses a laser-guided projectile system for guiding a spinning in-flight projectile by determining the deviation of the projectile from an optimum trajectory along which the projectile would impact a target, and transmitting a predetermined signal to the projectile from a remote source to subject the projectile to a correctional impulse of sufficient magnitude to alter the course of the projectile toward the intended target. However, this system is not self-contained on board the projectile nor does it utilize steering control surfaces in the manner of the present invention.

U.S. Pat. No. 4,537,371 to William S. Lawhorn, et al. discloses a small caliber guided projectile using flow control means for the control of exhaust through opposing nozzles to provide lateral position corrections to the projectile.

U.S. Pat. No. 1,243,542 to William R. Moore discloses a projectile having wings which will open when the projectile leaves a gun to prevent tumbling of projectile.

U.S. Pat. No. 4,431,150 to Edwin H. Epperson, Jr. discloses a gyroscopically steerable bullet having the capability for mid-course trajectory shaping thereby improving accuracy.

U.S. Pat. No. 4,711,152 to Chris M. Fortunko discloses an apparatus for transmitting data from the exterior of a gun tube to a projectile positioned within the gun tube utilizing at least two electromagnetic-acoustic transduction devices imparting updated target or trajectory information to the projectile.

U.S. Pat. No. 3,282,540 to Henry S. Lipinski discloses a gun launched guided projectile wherein the forward inner cone surface of a shaped charge includes a curved reflecting surface against which reflected light rays from the target entering the projectile nose are reflected onto a forward reflecting surface and thence to a target sensing device for determining the effectiveness of the projectile trajectory.

Finally, U.S. Pat. No. 4,893,815 to Larry Rowan is considered of general interest in that it discloses a multiple task user based weapons system capable of neutralizing a variety of designated target types within a real time interval well below conventional systems faced with equivalent tasks.

SUMMARY OF INVENTION

After much research and study into the above mentioned problems, the present invention has been developed to provide a small caliber, laser guided projectile system for guiding an in-flight bullet along an optimum projectory to impact a laser designated target.

The laser guided bullet of the present invention includes a self-contained guidance system having an array of symmetrically disposed, laser sensors capable of detecting a laser light beam reflected off of a remote target.

Sensory impulses from the laser sensors are transmitted to the on-board semiconductor logic circuit which determines the deviation of the bullet from an optimum trajectory. Thereafter, the on-board navigational electronics provide voltage to a piezo electric steering mechanism to alter the path of the bullet along its trajectory.

The electrical power required to produce the functions within the guidance system is supplied by an on-board miniature battery.

In view of the above, it is an object of the present invention to provide a sufficiently small and lightweight laser guided bullet so that a reasonably small caliber, such as a standard 0.50 caliber M-2 cartridge can be accurately guided to a remote target by use of a laser target signature Another object of the present invention is to provide a guided bullet that is launched by expanding gases in the manner employed by conventional bullets and is steered in flight by a self-contained guidance system that is capable of greater accuracy and precision than conventional bullets at all ranges.

Another object of the present invention is to provide a laser guided bullet that is steered in flight by a self-contained guidance system capable of determining the deviation of the bullet from an optimum trajectory along which the same will impact a target and of generating a correctional impulse to piezo electric actuated control surfaces to alter the course of the bullet toward the optimum trajectory.

Another object of the present invention is to provide a laser guided bullet capable of satisfactory performance under normal operating conditions thereby compensating for unknown factors and human operator limitations. Such unknown factors include but are not limited to wind, barometric pressure, humidity, effective impact with rain, sleet, snow, hail, or airborne soil particles, and movement of the target. Such human operator limitations include but are not limited to eyesight resolution, neuromuscular coordination, heartbeat, and respiration induced motion.

Another object of the present invention is to provide a laser guided bullet which may be produced by existing micro-manufacturing methods in an economically viable package.

Other objects and advantages of the present invention will become apparent and obvious from a study of the following description and the accompanying drawings which are merely illustrative of such invention.

DETAILED DESCRIPTION OF THE PREFERRED EMBODIMENT

Before describing the guided bullet 10 of the present invention in detail, it may be beneficial to review the structure and function of precision rifles wherein the guided bullet 10 of the present invention is to be utilized.

By definition all rifles, precision or otherwise, have rifled barrels, that is, their barrels are tubes containing spiral grooves etched into the inner barrel wall. When a conventional unguided bullet has been fired from a rifle barrel, the surfaces of the grooves therein grip the bullet and impart a spin to the same. Spinning the conventional, unguided bullet provides a gyroscopic stability to the in-flight projectile.

In contrast, the guided bullet 10 of the present invention is designed to be fired from a non-rifled, smooth bored gun barrel. Imparting a spin to the guided bullet 10 of the present invention would not only be unnecessary, but it would also be detrimental to the performance of the same.

The gyroscopic stability imparted to a conventional, unguided bullet fired from a conventional rifled gun barrel creates an additional resistance to be overcome by the steering control mechanism. Thus, imparting a spin to the guided bullet 10 would require the logic circuit 28 included in the on-board navigational electronics to compensate for a phase displacement in the steering commands sent to the control surfaces as described hereinafter. Because the guided bullet 10 must incline its longitudinal axis relative to its trajectory to achieve steering, gyroscopic stability is undesirable.

As precision rifles used by sniper trained personnel have evolved, certain standards for precision and accuracy have emerged. The sniper rifle has a ballistic advantage over the normal infantry weapon do to its ability to perform reliably at longer ranges. The ballistic advantage of the sniper rifle occurs when it is capable of placing all of its shots into an area which, at the distance of the area from the rifle, subtends two to three minutes of angle.

Most contemporary sniping authorities place the minimum standard of performance for a sniper rifle at one minute of angle. Sniper rifles entering service with the United States Army are required to place shots in one-half of a minute of angle.

Even with a high level of performance, most sniper rifles have an effective range of not more than 1,000 meters. When the sniper's mission necessitates that the shot be fired from greater than 800 to 1,000 meters, a heavy sniper rifle will likely be used.

Figure 1:
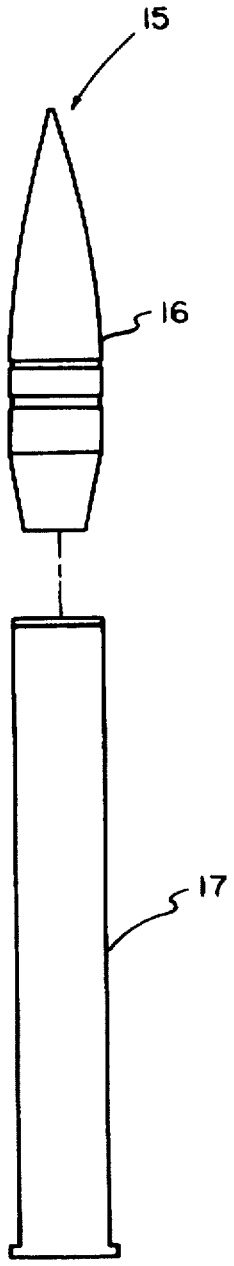
FIG. 1 PRIOR ART
FIG. 1 is an exploded plan view of a standard 12.7×99 mm N.A.T.O. (0.50 caliber M-2) cartridge utilized in conjunction with the present invention.

The standard cartridge used in a heavy sniper rifle by the United States Armed Forces and N.A.T.O. Forces is the 12.7×99 millimeter N.A.T.O. (0.50 caliber M-2) cartridge as shown in FIG. 1, indicated generally at 15 and labeled PRIOR ART.

The 0.50 caliber cartridge 15 includes a generally cone-shaped projectile or bullet 16 which is secured about its mid-section within a cylindrical case 17 containing a gun powder charge (not shown).

Thus, the guided bullet 10 of the present invention is designed to be propelled by a standard 0.50 caliber M-2 cartridge (12.7×99 mm) presently in use by the United States Armed Forces. The 12.7×99 mm N.A.T.O. (0.50 caliber M-2) cartridge is the largest cartridge and fires the largest bullet currently in small arms standard use.

Since such conventional, unguided bullet cartridges are well-known to those skilled in the art, further detailed discussion of the same is not deemed necessary.

Under normal operating conditions, the ballistics of such small caliber projectiles are well known. However, due to random processes and unknown factors involving small differences and effects of powder load, projectile shape and mass, frictional forces as the projectile leaves the gun barrel, fluctuations in wind and air density, barometric pressure, humidity, the effect of impact with rain, sleet, snow, hail, or other airborne soil particles, a small caliber projectile may deviate from an optimum projectory along which the same would impact a target.

Thus, there is a need for a self-contained guidance system for guiding an in-flight, small caliber projectile toward an optimum trajectory along which the bullet would impact a target.

In order to simplify the description of the guided bullet 10 of the present invention, it may be beneficial to briefly review the function of a laser beam in designating a target in this context.

The light energy from a laser can be concentrated into a very narrow beam. The angle subtended by the laser beam at the ranges of interest for the present invention is dependent upon the quality of the optics in the laser apparatus, but also upon fluctuations in the density in the atmosphere, that is, refractive or bending effects, and to energy loss due to interactions from scattering processes with small density fluctuations or particulate matter such as dust or water droplets as the scattering centers. The angular width of the laser beam can be quite small.

Since the laser beam intercepts air density fluctuation or concentrations of particulate matter suspended within the atmosphere, a certain fraction of the beam power is scattered out of the beam and lost. However, the scattered intensity is in the generally forward direction of propagation of the beam.

Figure 2:
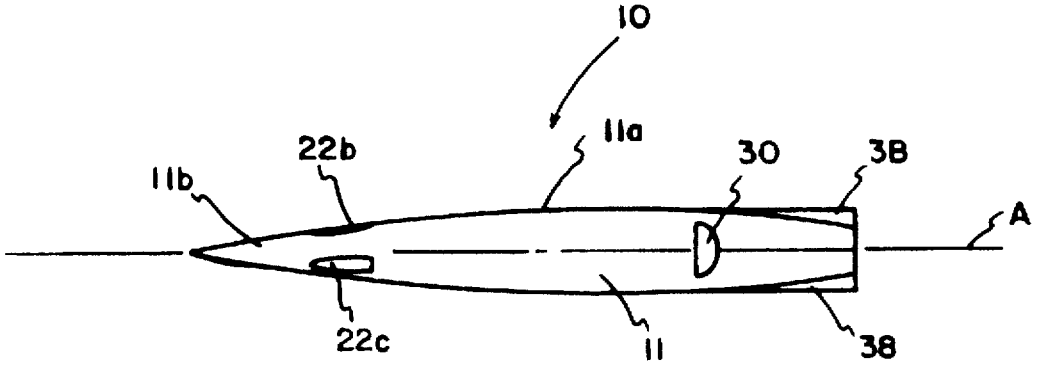
FIG. 2 is a side elevational view of the guided bullet of the present invention.

When a laser beam is placed on a target, the beam is partially reflected in many different directions. Initially, the laser beam would be coherent and unseen by the laser sensor array, indicated generally at 20, unless the laser beam were to be pointed directly at the laser sensor array 20 as shown in FIG. 2. Thus, the laser sensor array 20 could only detect that part of the laser beam that would be reflected by the target toward the guided bullet 10.

Figure 3:
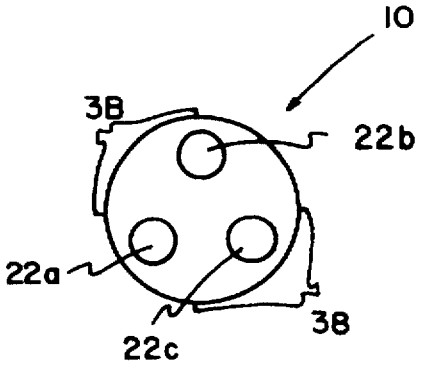
FIG. 3 is a front elevational view of the guided bullet of the present invention showing the symmetrical arrangement of the laser sensor array.

The laser sensor array 20 of the present invention utilizes a plurality of individual laser sensors 25 in order to detect a laser illuminated target position that does not lie on the longitudinal axis A of the guided bullet 10. The laser array 20 is comprised of individual laser sensors 22 which are arranged symmetrically about a longitudinal axis A of the guided bullet 10 as shown in FIG. 3.

In the preferred embodiment three sensors **22*a*, 22*b*, and 22*c* are positioned symmetrically about the longitudinal axis A of the guided bullet 10** to provide the simplest configuration for detecting the radiant energy of the laser beam.

Figure 4:
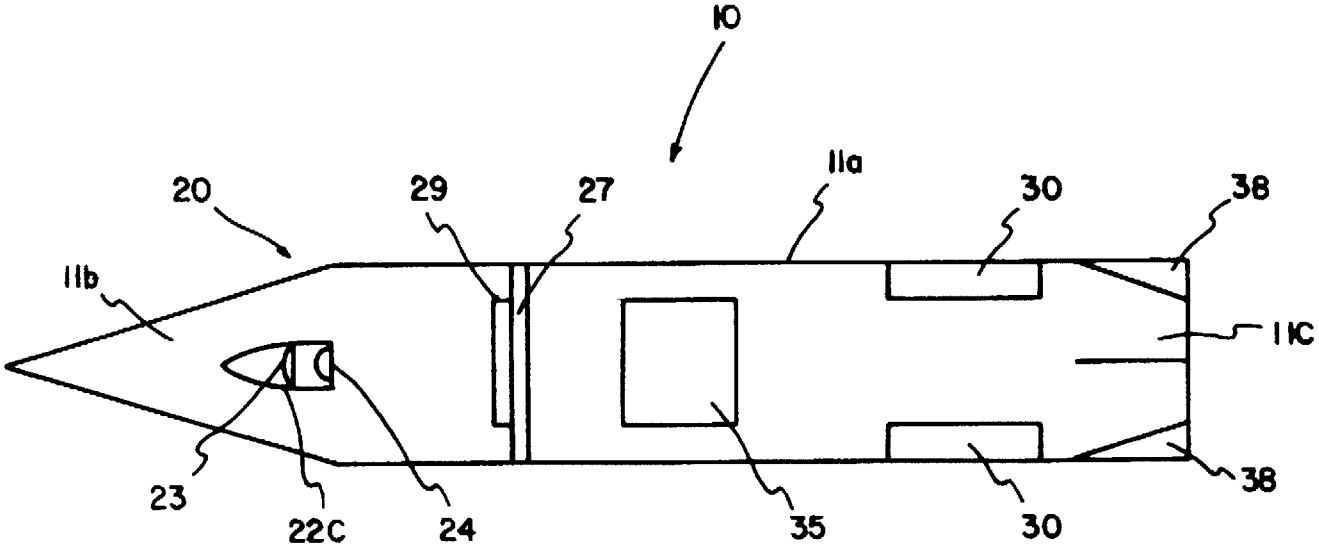
FIG. 4 is a schematic view of the guided bullet containing a guidance system in accordance with the present invention and the components thereof.

As the guided bullet 10 moves in the general direction of the laser illuminated target, a sufficient fraction of the laser beam energy is intercepted and transmitted through each respective sensor lens 23 that is focused on the sensitive photo detector elements 24 contained within each sensor 22 as shown in FIG. 4. The photo detector elements 24 maybe fabricated from a variety of currently available materials responsive to laser radiation and capable of converting the laser radiation into electrical signals.

Since such laser sensors are well known to those skilled in the art, further detailed discussion of the same is not deemed necessary.

Figure 5:
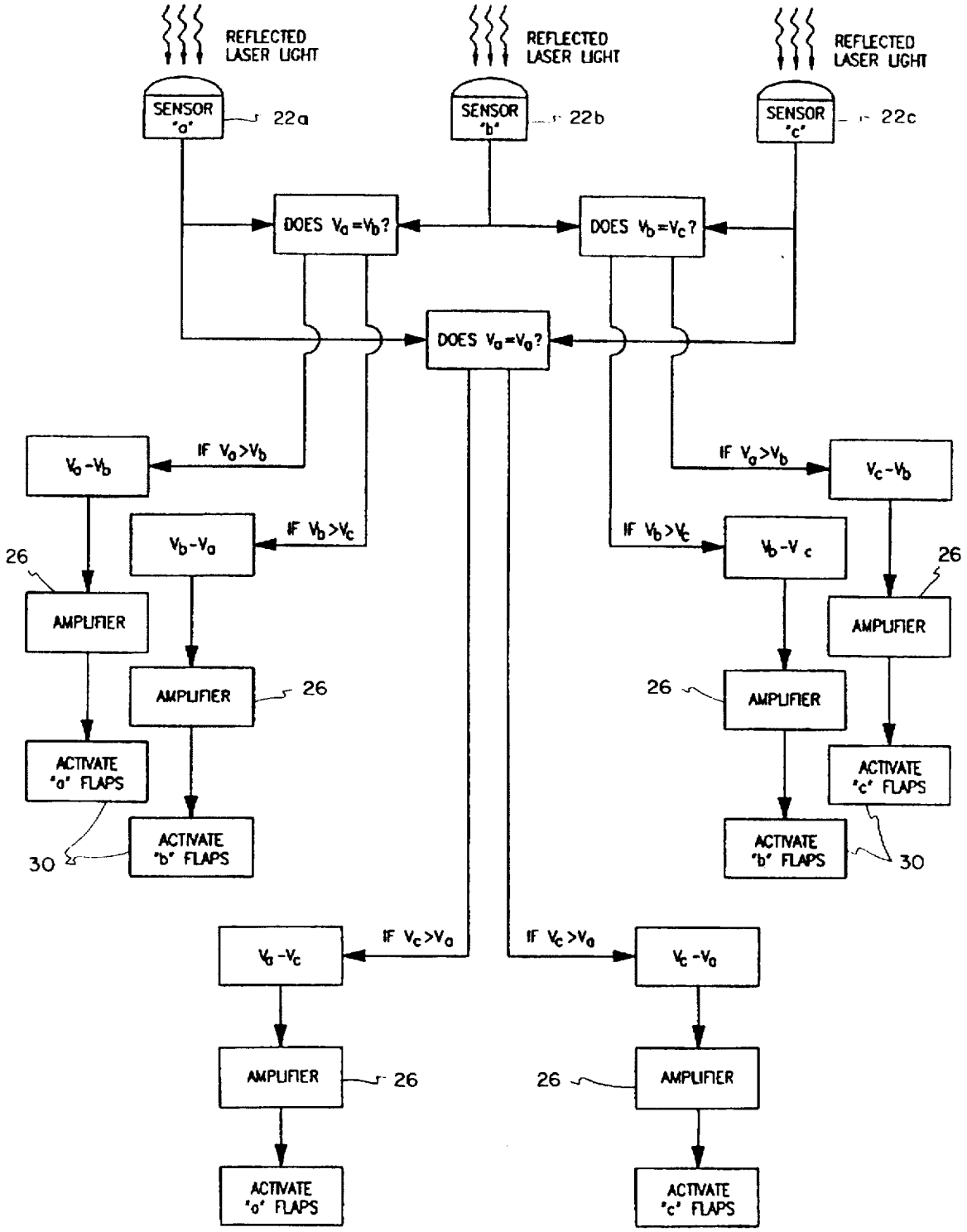
FIG. 5 is a block diagram illustrating the logic circuit of the present invention and the integrated components thereof.

The electrical signals generated by the photo detector elements 24 are received by a logic circuit 28 integrated into a dedicated semiconductor chip 29 installed within the guided bullet 10 as shown schematically in FIG. 5.

The electrical signals are amplified by micro-circuit amplifiers 26 to produce the functions required by the guidance system as shown in FIG. 5. The V in FIG. 5 represents the voltage signal generated by each respective photo detector element 24 corresponding to its laser sensor 22. Thus, Va represents the voltage signal produced by laser sensor **22*a*** in response to the laser radiation intercepted thereby, etc.

The semiconductor chip 29 is installed on a generally flat plate 27 positioned within bullet 10 in generally perpendicular relation to axis A as shown in FIG. 4

Since such semiconductor circuits are in a practical state of development and well known to those skilled in the art, further detailed discussion of the same is not deemed necessary.

The guided bullet 10 utilizes steering control surfaces to rotate the longitudinal axis A of its body out of alignment with the present direction of bullet travel. Thus, the guidance system is capable of generating a correctional signal to the steering control surfaces in response to the sensory input received from the laser sensors 22 to translate the bullet 10 to the optimum trajectory to hit the target. Tail fin stabilization will be required to impart directional stability to the guided bullet 10 in virtually all distance ranges to prevent tumbling of the projectile once it is subjected to a corrective moment from the steering control surfaces.

Figure 12:
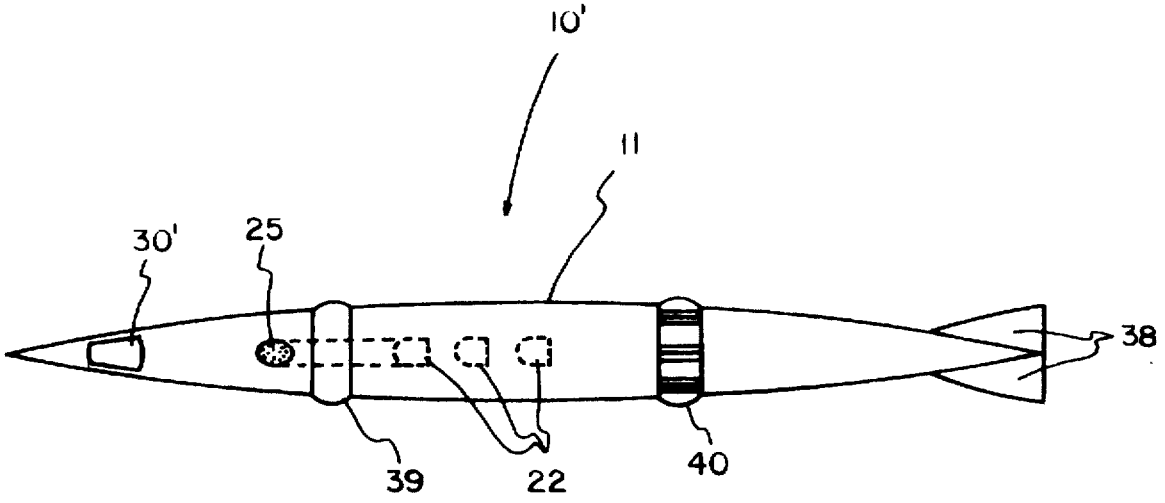
FIG. 12 is a side elevational view of an alternative embodiment of the guided bullet of the present invention.

When utilized for stabilization, a plurality of fixed fins 38 are equally spaced circumferentially around the rearward end of the bullet body 11 as shown in FIG. 12. In the embodiment shown four identical fins 38 are incorporated to form a tetragonal arrangement.

The present invention utilizes deployable flaps 30 as steering control surfaces as shown in FIG. 4. Such deployable flaps 30 are comparable to aircraft flight control surfaces known as spoilers which function to increase drag and to decrease lift.

As necessary, the deployable flaps 30 are extensible out from the body 11 of the guided bullet 10 to deflect the air stream to effect steering of the guided bullet 10. When the deployable flaps 30 are not needed to translate the bullet 10 toward the optimum trajectory, the flaps 30 are disposed flush with the outer surface 11*a* of the guided bullet body 11 as more clearly shown in FIG. 11A.

Figure 11A:
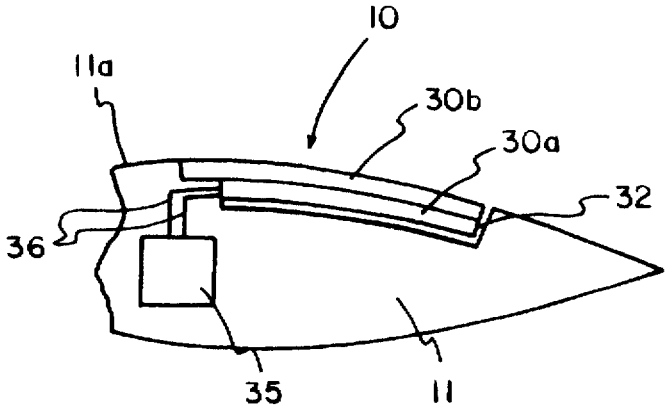
FIG. 11A is a partial longitudinal section view of the guided bullet showing a deployable flap in the absence of a control voltage being applied thereto.
Figure 11B:
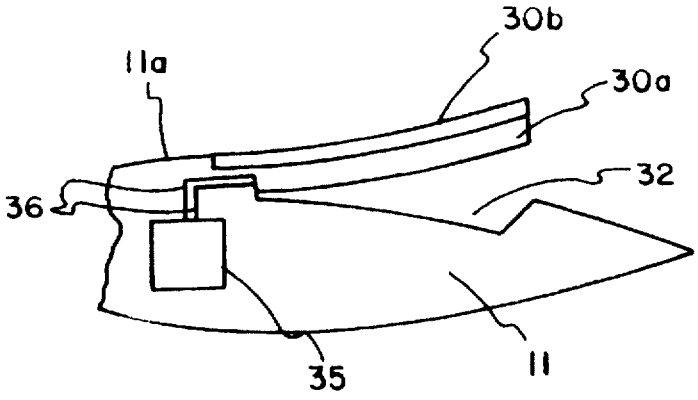
FIG. 11B is a partial longitudinal section view of the deployable flap of FIG. 11A shown with a control voltage being applied thereto.

In the preferred embodiment, the deployable flaps 30 are fabricated using either hard or soft piezo electric material. Such piezo electric materials are capable of extension along one axis and contraction along another when subjected to an electric field and may be constructed in either a unimorph or bimorph configuration as is well known to those skilled in the art. As can be seen in FIGS. 11A and 11B, each of the flaps 30 are manufactured in a layered configuration including an inner layer 30*a* comprising piezoelectric material permanently bonded to the underside of an outer layer 30*b* of a synthetic material such as KEVLAR or other suitable material capable of withstanding bore firing pressures and temperatures.

As shown in FIG. 11A, flap 30 is configured to closely conform to and to be disposed within a recessed area as at 32 formed in the outer surface 11*a* of the guided bullet body 11.

In the presence of an applied controlled voltage provided by an onboard power source, the piezoelectric layer 30*a* is extended in length along its longitudinal axis causing the outer layer 30*b* of KEVLAR to bend outwardly beyond the outer surface 11*a* of the bullet body 11 as shown in FIG. 11B.

Since such piezo electric materials are well known to those skilled in the art, further detailed discussion of the same is not deemed necessary.

Thus, the piezo electric flaps 30 are extensible from the body 11 of the guided bullet 10 to deflect the air stream in order to correct the in-flight course of the bullet 10 along a desired trajectory. This is accomplished through the onboard logic circuit 28 which controls the flow of electrical current to the piezo electric flaps 30.

Electrical power to operate the guided bullets sensors 22, logic circuit 28 and piezo electric flaps 30 is provided by an onboard miniature battery 35 which provides sufficient duration of electrical power supply to support the functions of the guidance system.

In the preferred embodiment, a lithium-polymer battery provides the most suitable power source for the guided bullet 10. Lithium-polymer batteries have an unusually thin cell thickness on the order of hundreds of micrometers During the firing process, the miniature battery 35 is subjected to potentially damaging acceleration. Most conventional batteries are constructed starting with a metal cup. This metal cup is filled with the appropriate chemical composition. The combination of metal cup and appropriate chemical composition is sealed within a metal cap. The metal cap is electrically separated from the metal cup by an electrical insulating medium. If a battery of this type of construction is subjected to sufficiently large acceleration, the battery will fail structurally. If the battery fails structurally, the battery will almost certainly fail electrically.

Since a lithium-polymer battery is thinner than most batteries and layered, the lithium-polymer battery 35 can constructed to withstand the guided bullet 10 firing acceleration. This is mentioned because this invention is only possible in practice by the use of such a battery. Control voltages are applied to the piezoelectric flaps from the battery 35 through the integrated functions of logic circuit 28. The battery 35, flaps 30 and logic circuit 28 are electrically connected by conductors such as wires (not shown) sheathed in an insulating coating and embedded in plurality of channels 36 formed in the body 11 of the guided bullet.

The channels 36 are formed in the bullet body 11 by drilling, milling, or other known machine tool processes.

The insulated conductors are rigidly secured within channels 36 by epoxy or other suitable adhesive means to withstand bore firing pressures.

In an alternative embodiment the electrical conductors are comprised of an electroconductive paint mixed with an epoxy compound which fills channels 36 to electrically interconnect the components of the guidance system.

Since such electroconductors are well known to those skilled in the art, further detailed discussion of the same is not deemed necessary.

Turning now to FIG. 12, there is shown therein an alternative embodiment of the guided bullet of the present invention indicated generally at 10'. In this embodiment a plurality of deployable flaps 30' are symmetrically disposed about the forward end 11*b* of the projectile to translate the guided bullet 10' toward the optimum trajectory in substantially the same manner as described hereinabove.

In this embodiment the deployable flaps 30' are constructed of the same piezoelectric materials and the control voltages are applied thereto in essentially the same manner as previously described herein.

Although the aerodynamic effects of the forward mounted steering flaps 30' on the in-flight projectile and the correctional momentum imparted to the in-flight bullet may vary considerably from the rearward flaps 30 such variable parameters are considered to be within the scope of the present invention.

A significant difference in the embodiment shown in FIG. 12 is the inclusion of a plurality of laser sensor patches, which are equally spaced circumferentially about the forward end of the bullet 10'. The sensor patches 25 are comprised of a fiber optic material which optically connects the laser sensors 22 that are disposed internally of the bullet body 11'.

In this arrangement a plurality of laser sensors 22 may be disposed in axial alignment along the longitudinal centerline of the projectile such that only their respective sensor patches 25 extend to the external surface of the bullet body 11 thereby permitting a reduction in outside diameter and caliber of the guided bullet 10'.

Still referring to FIG. 12 the guided bullet 10' is provided with a forward sealing/alignment ring 39 and a rearward alignment ring 40 which are disposed circumferentially around the body 11 of the projectile.

Figure 13:
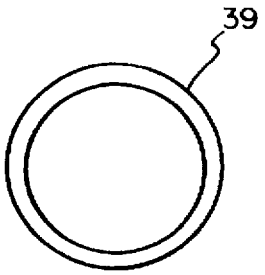
FIG. 13 is a cross sectional view of the forward sealing/alignment ring of the alternative embodiment of the guided bullet depicted in FIG. 12.
Figure 14:
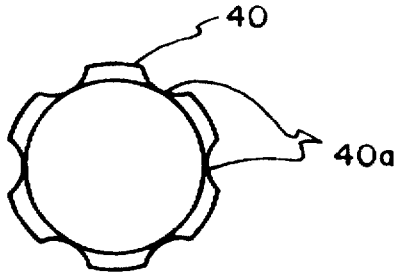
FIG. 14 is a cross sectional view of the aft alignment ring of the alternative embodiment of the guided bullet depicted in FIG. 12.

In the preferred embodiment both the forward sealing/alignment ring 39 and the rearward alignment ring 40 are circular in configuration as more clearly shown in FIGS. 13 and 14 respectively.

In the preferred embodiment both rings 39 and 40 are fabricated from a soft metal or plastic material and function to align the guided bullet 10' in the bore of the firing rifle and to protect surfaces of the guided bullet body 11 and the bore of the weapon (not shown) from friction and damage during firing. In addition, the forward ring 39 functions to reduce leakage of combustion gases during firing while the rearward ring 40 includes a plurality of symmetrically spaced undercut areas 40*a* which permit the flow of combustion gases past the rearward ring 40 during firing.

In this alternative embodiment directional stability is provided by a plurality of fixed tail fins 38 which are equally spaced circumferentially around the rearward end of the bullet body 11.

In the following description, consideration is given to how the guidance system of the guided bullet 10 is effected in practice. Initially, it is assumed that the guided bullet is installed into a standard 0.50 caliber M-2 cartridge (12.7×99 mm) presently in use by the United States Armed Forces. More particularly, the diameter of the guided bullet 10 is 12.954 mm (0.510 inches) in diameter, the same diameter as the conventional, unguided bullet of this caliber.

In the preferred embodiment, the body 11*b* of the guided bullet is fabricated from copper or other suitable metal alloy.

The maximum acceptable overall length of the standard 0.50 caliber M-2 cartridge is 138.43 mm (5.45 inches), if it is desired for the cartridge to be used in auto-loading weapons such as semi-automatic precision sniper rifles. If the guided bullet 10, as assembled in the standard 0.50 caliber M-2 cartridge, is to be used in a manually loaded weapon, the overall length may exceed 138.43 mm.

A weapon which is configured to fire the guided bullet 10 will have no rifling to affect the seating depth of the guided bullet 10 as loaded in the standard 0.50 caliber M-2 cartridge. Since the guided bullet 10 will be used in smooth bored, manually loaded precision sniper weapons the overall cartridge length can exceed the maximum acceptable cartridge length for the standard 0.50 caliber M-2 cartridge.

A conventional, unguided standard 0.50 caliber M-2 bullet will travel 3,000 meters in approximately 16 seconds. Under optimum conditions the laser beam will be directed at the target at an appropriate angle so that at or near the mid-point of the bullet flight any deviation from the optimum trajectory can be corrected. More particularly, the guided bullet 10 will acquire the target signature and begin navigating toward the target when it is less than approximately 1,100 meters from that target. Since the guided bullet 10 will most likely use electrical power only in the last 1,100 meters or less of travel, significant power consumption will not occur for more than three seconds.

A simplified way of considering the trajectory correction required is contained in the following analysis.

It is first assumed that E is the energy necessary for course correction. y is the lateral distance movement necessary for course correction. Fy is the lateral force on the guided bullet 10 necessary for course correction. This may be written as follows:

$$Fy=E/y$$

Fx is the force along the x-axis.

$$Fx=A\cdot p\cdot va^2\cdot(1-\cos(\theta))Cd$$

A=the cross sectional area for the bullet. Cd=coefficient of drag, p is obtained by a linear interpolation of air density data. p is the density of air in kilograms per cubic meter.

$$p=120+(20-temp)\cdot 0.045$$

v=the velocity of the bullet at a given position of the bullet in travel a=sample bullet specimen having a coefficient of drag equal to 0.2

θ=elevation angle of bullet

Fy is the force along the y-axis.

$$Fy=A\cdot p\cdot va^2\cdot(1-\sin(\theta))$$

tL is the typical minimum thickness of a single soft piezo electric strip in meters.

$$tL=1\cdot 10^{-4}$$

R is the radius of a single activated soft piezo electric strip. ΔL is the change in length of a single activated soft piezo electric strip in meters.

$$\Delta L=\frac{R+tL/2}{2/R\cdot L-L}$$

ε is the strain of a single activated soft piezo electric strip.

$$\epsilon=\Delta L/L$$

d31 is the piezo electric sensitivity in meters per Volt.

$$d31-275\cdot 10^{-12}$$

V is the required voltage in Volts $$V=\epsilon/d31\cdot tL$$

Appropriate logic or computational elements in the logic circuit 28 would select the optimum discrete voltage input to activate the piezo electric flaps 30 to effectuate the optimum trajectory correction as depicted in FIG. 5, which would depend upon the following factors: the force necessary to correct for the wind on the guided bullet 10 versus the distance traveled by the bullet 10, energy necessary to correct for the force of the wind on the bullet 10 versus the distance traveled by the bullet 10, power necessary to correct the force of the wind on the bullet 10 above the muzzle versus the distance traveled by the bullet 10, vertical angle known as the vertical field of view necessary for the bullet sensors 22 to acquire the laser target signature versus the distance traveled by the bullet 10, horizontal angle known as the horizontal field of view necessary for the bullet sensors 22 to acquire the target signature versus the distance traveled by the bullet 10, and the resultant angle known as the field of view necessary for the bullet sensors 22 to acquire the target signature versus the distance traveled by the bullet 10.

Figure 6:
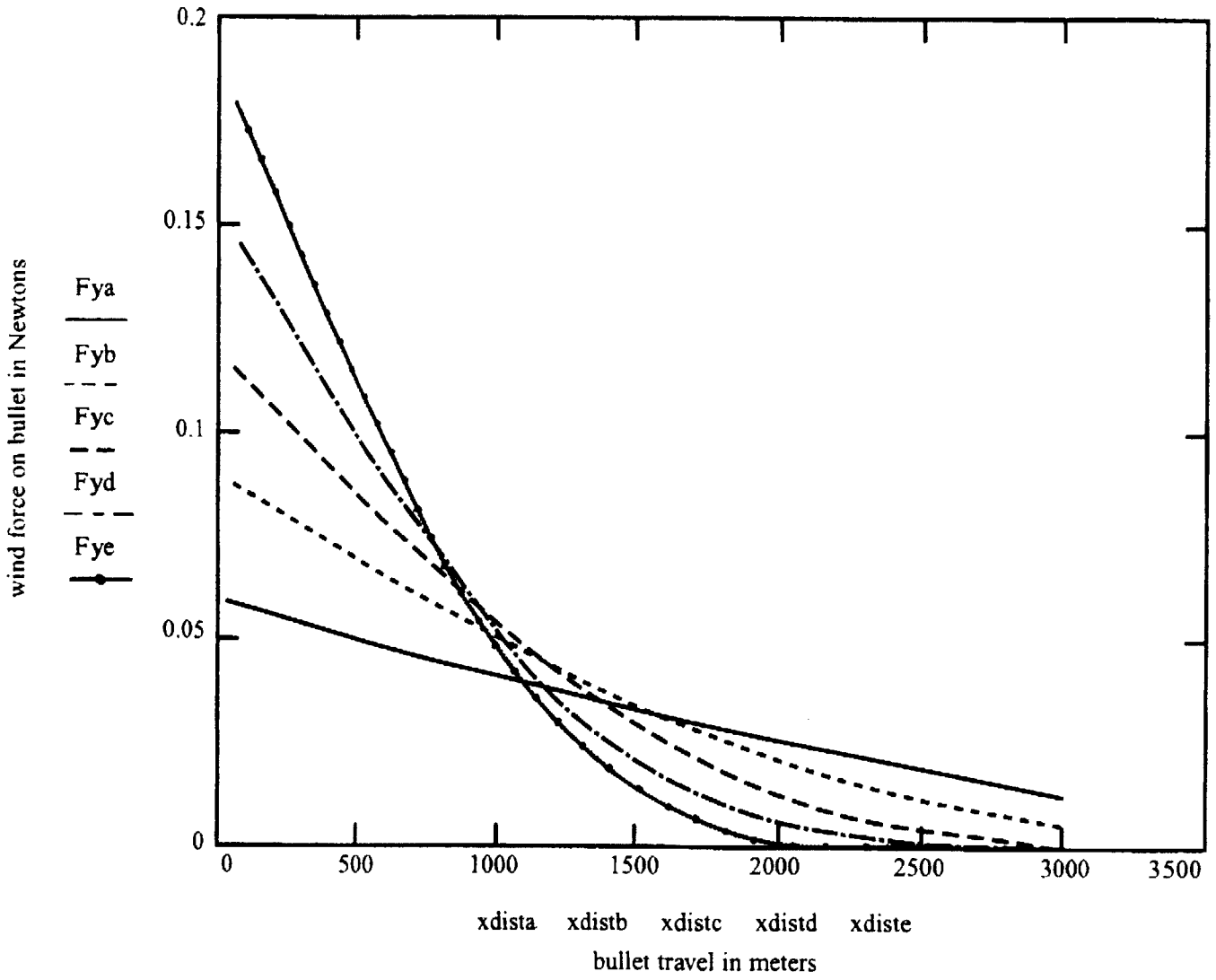
FIG. 6 is a graphic depiction of the force necessary to correct for the force of the wind versus the distance traveled by the guided bullet.
Figure 7:
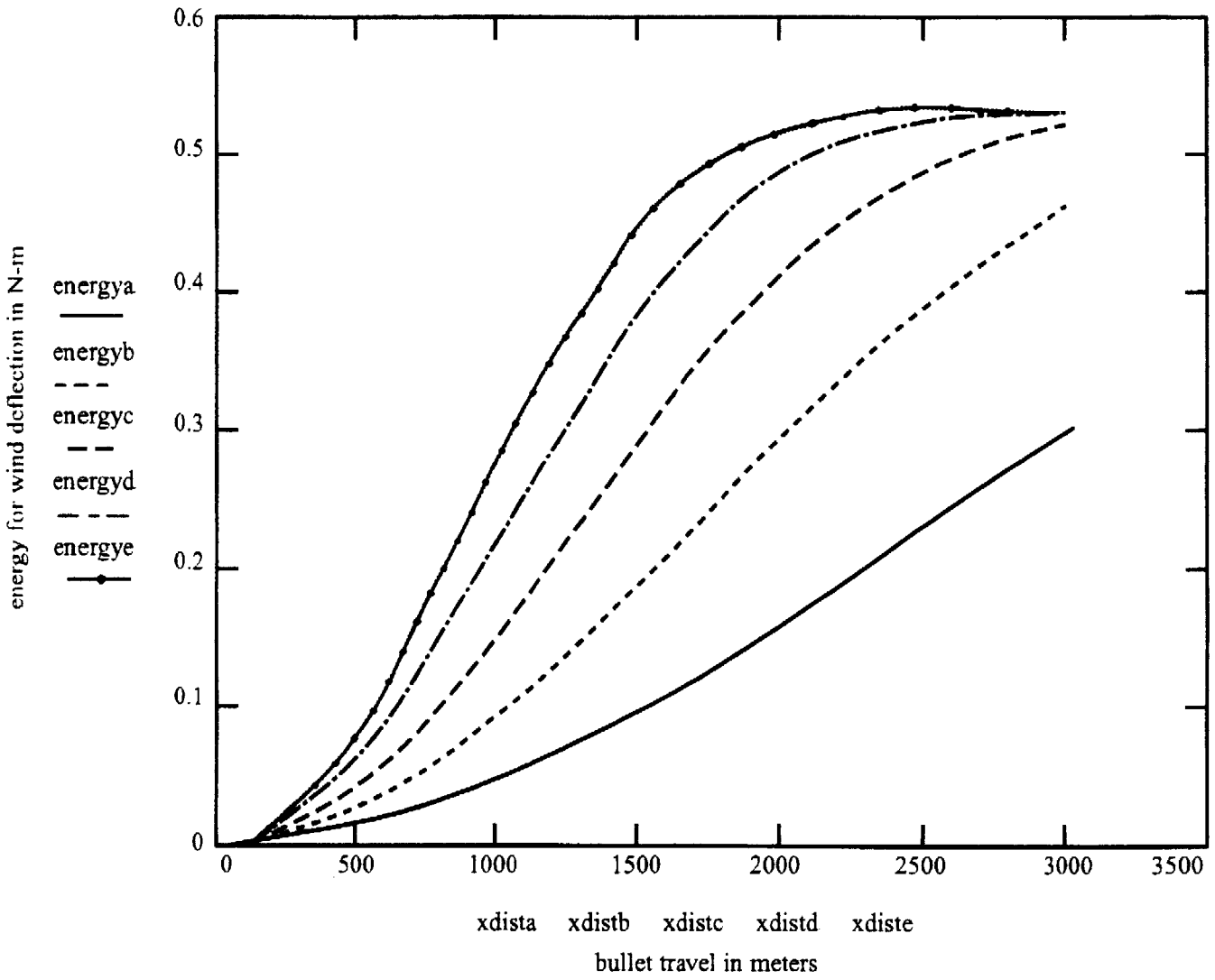
FIG. 7 is a graphic depiction of the energy necessary to correct for the force of the wind versus the distance traveled by the guided bullet.
Figure 8:
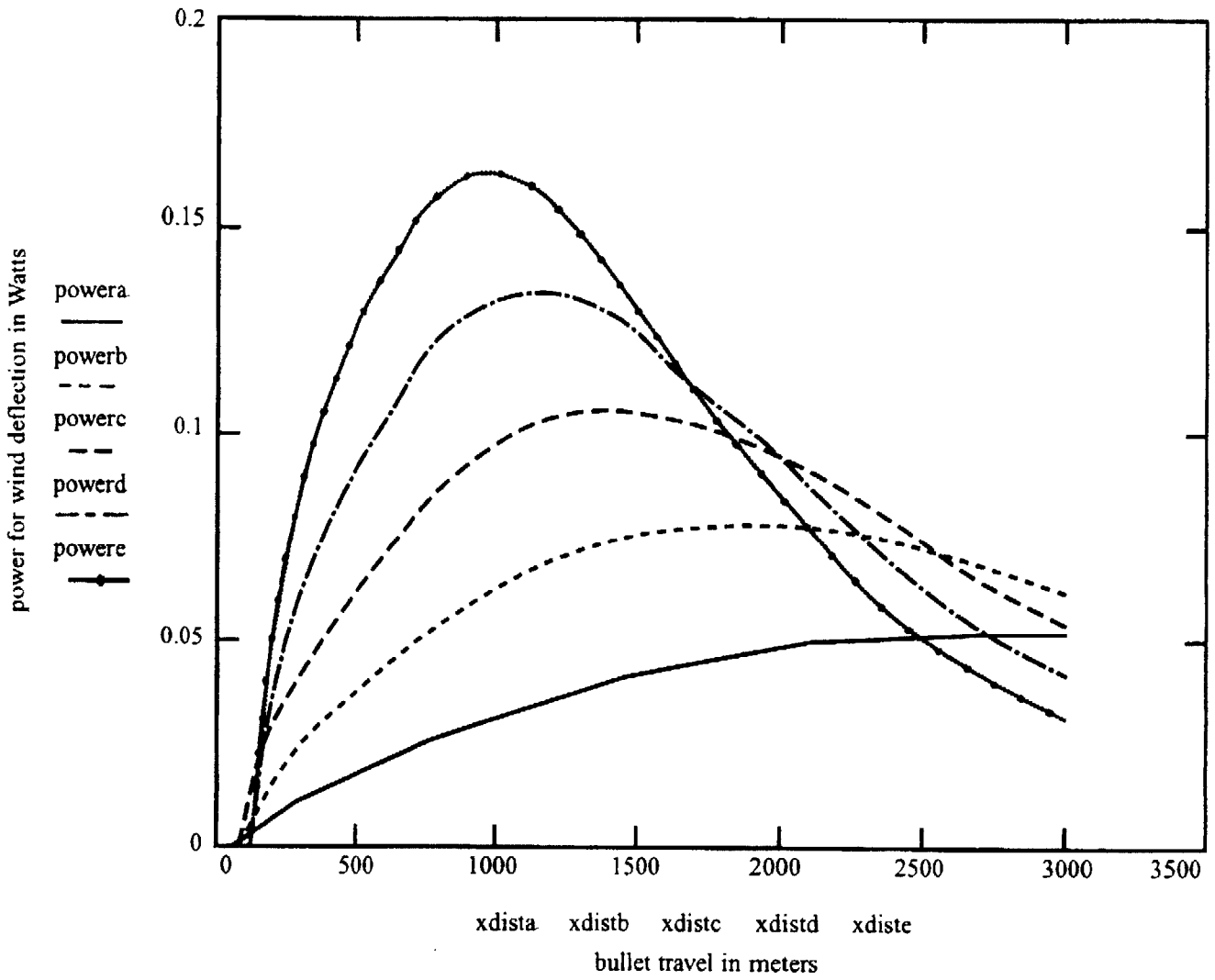
FIG. 8 is a graphic depiction of the power necessary to correct for the force of the wind versus the distance traveled by the guided bullet.
Figure 9:
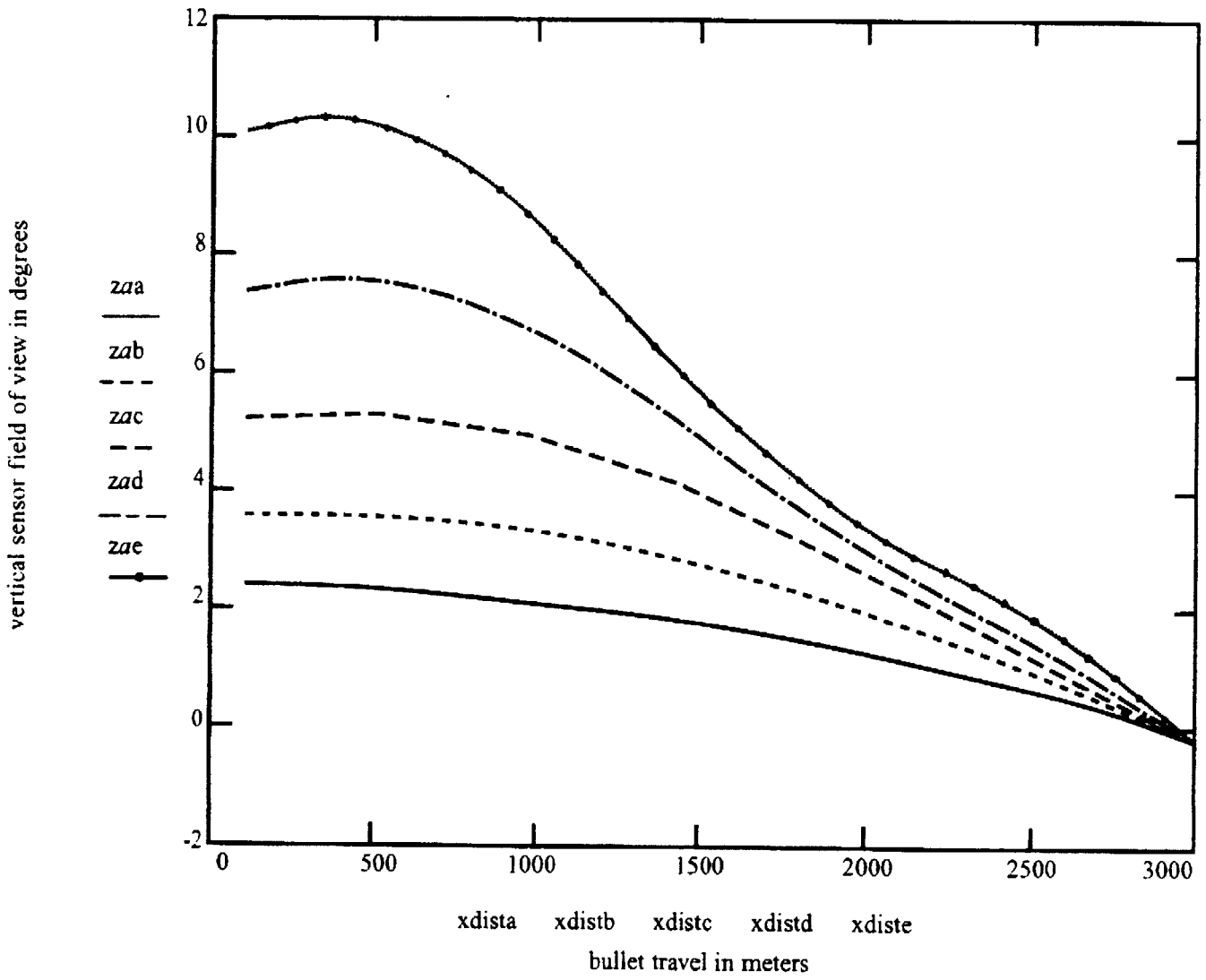
FIG. 9 is a graphic depiction of the vertical sensor angle necessary to correct for the force of the wind versus the distance traveled by the guided bullet.
Figure 10:
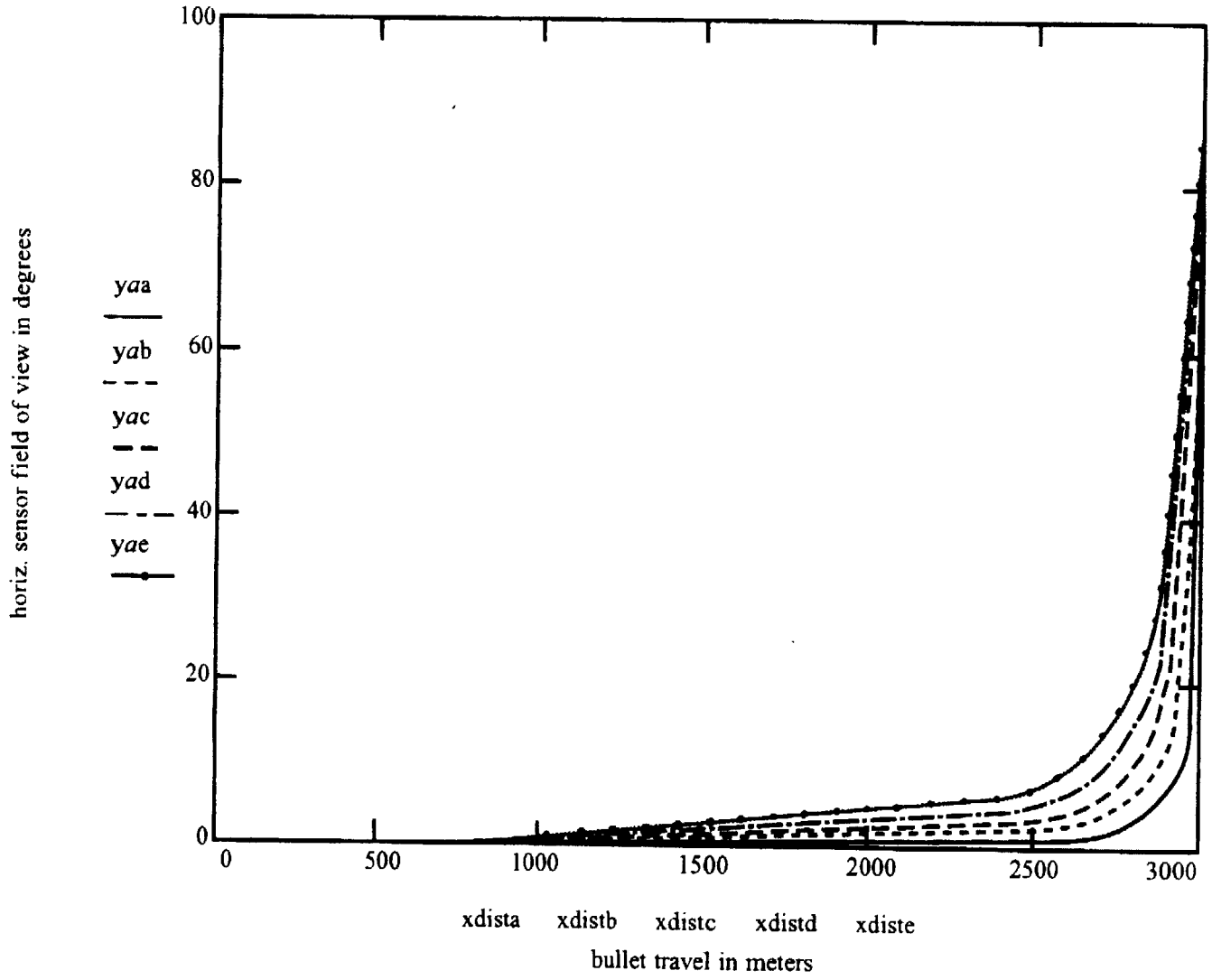
FIG. 10 is a graphic depiction of the horizontal sensor angle necessary to correct for the force of the wind versus the distance traveled by the guided bullet.

The force necessary to correct for the force of the wind versus the distance traveled by the bullet 10 is shown in FIG. 6. The energy necessary to correct for the force of the wind versus the distance traveled by the bullet 10 is shown in FIG. 7. The power necessary to correct for the force of the wind versus the distance traveled by the bullet 10 is shown in FIG. 8. The vertical sensor angle necessary to correct for the force of the wind versus the distance traveled by the bullet is shown in FIG. 9. The horizontal sensor angle necessary to correct for the force of the wind versus the distance traveled by the bullet is shown in FIG. 10.

It will be appreciated that the data presented in FIGS. 6–10 is based on a flight simulation of five distinct guided bullet specimens, namely a, b, c, d, and e.

Each respective bullet specimen has a different coefficient of drag value simulating a wide range of atmospheric conditions under which the guided bullet 10 will function.

More specifically, the respective coefficient of drag values are as follows:

| Bullet Specimen | Coefficient of Drag Value |
|---|---|
| a | 0.2 |
| b | 0.3 |
| c | 0.4 |
| d | 0.5 |
| e | 0.6 |

The flight simulation data contained in FIG. 6–10 is provided to demonstrate that the forces required for course correction of the guided bullet 10 are within the functional capability of the hereinabove described ballistic and navigational technologies.

The computation of the trajectory of the guided bullet including deceleration due to air drag and calculation of the target position including elevation angle, and the determination of the optimum aiming direction is straightforward and reduced to practice and would require no further explanation to those reasonably skilled in this art.

From the above it can be seen that the laser-guided bullet of the present invention provides a method and system for guiding a small caliber projectile to an optimum trajectory along which the same would impact a hostile target. The guided bullet includes a self-contained guidance system capable of generating a correctional signal by means of a dedicated semiconductor logic circuit which actuates piezo electric steering surfaces on the bullet to translate the projectile toward the optimum trajectory.

The guided bullet of the present invention utilizes ballistic and navigational technologies which are in a practical state of development.

Because of the degree of precision that is required in the fabrication of the guided bullet and the small scale of the work, micro electromechanical manufacturing offers the potential for the lowest production cost of the present invention.

The terms "forward", "rearward", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A bullet guidance system for guiding an in-flight bullet along an optimum trajectory along which said bullet would impact a laser-identified target, said system comprising:

laser beam detecting means contained within said bullet and being capable of receiving laser beam energy reflected from said target and converting said energy to electrical impulses;

logic circuit means contained within said bullet having means therein responsive to receipt of said impulses for determining the deviation of said bullet from said optimum trajectory and for generating corrective signals in response to said impulses;

steering control means having means therein responsive to said corrective signals in a manner to actuate said steering control means so as to deflect air flow about said bullet, said control means including at least deployable flap means being outwardly extensible from said bullet to deflect air flow about said bullet to impart a correctional momentum to translate said bullet to said optimum trajectory, said bullet being fired from a precision, smooth-bored weapon thereby not imparting axial spin to said bullet in the manner of a rifle; and power supply means contained within said bullet being interconnectable to said logic circuit and said steering control means to provide sufficient electrical power to produce the functions required by said system.

2. The bullet guidance system of claim 1 wherein said detecting means includes a plurality of laser sensors being symmetrically disposed about a longitudinal axis of said bullet, said sensors being located in a plane perpendicular to the axis and being arranged to receive said laser beam energy in an opposite direction to the direction in which said bullet is moving.

3. The bullet guidance system of claim 1 wherein said logic circuit means includes amplification means being integrated thereto for amplifying said impulses received from said detecting means.

4. The bullet guidance system of claim 1 wherein said logic circuit means includes amplification means and is contained in a semiconductor chip within said bullet.

5. The bullet guidance system of claim 4 wherein said semiconductor chip is installed on a flat plate means on a forward side thereof, said plate means being located in a plane perpendicular to said axis of said bullet.

6. The bullet guidance system of claim 1 wherein said deployable flap means are at least partially fabricated from piezo electric materials enabling said flap means to be expanded when subjected to said corrective signals.

7. The bullet guidance system of claim 1 wherein said power supply means is a miniature battery contained within said bullet.

8. The bullet guidance system of claim 7 wherein said battery is a lithium-polymer battery.

9. The bullet guidance system of claim 1 wherein said bullet is propelled by a powder cartridge.

10. The bullet guidance system of claim 9 wherein said cartridge is a 0.50 caliber cartridge.

11. A method of guiding an in-flight bullet along an optimum trajectory to a laser-identified target, said bullet including a self-contained guidance system including laser detection means capable of receiving laser beam energy and converting said energy to electrical impulses, logic circuit means responsive to receipt of said impulses for determining the deviation of said bullet from said optimum trajectory and for generating corrective signals in response to said electrical impulses for actuating steering control means in a manner to deflect air flow about said bullet thereby effecting a corrective momentum to translate said bullet to said optimum trajectory, said method comprising the steps of:

illuminating the target with a laser;

firing said bullet from a precision sniper rifle having a smooth internal bore at said target;

detecting laser beam energy reflected from said target using laser sensors;

converting said energy to electrical impulses;

determining the deviation of said bullet from said trajectory by analysis of said electrical impulses;

generating corrective signals in response to said electrical impulses; and actuating said steering control means in response to said corrective signals in a manner to deflect air flow about said bullet to impart a correctional momentum to said bullet whereby said bullet is translated toward said optimum trajectory to impact said target.

12. The method of claim 11 wherein the step of detecting is carried out by a plurality of laser sensors symmetrically disposed about a longitudinal axis of said bullet.

13. The method of claim 11 wherein the step of converting is carried out by photo detector elements within said sensors.

14. The method of claim 11 wherein the step of determining is carried out by a semiconductor logic circuit.

15. The method of claim 11 wherein the step of determining is carried out by piezo electric materials integrally formed with said control means.

16. The method of claim 11 wherein the step of firing further includes propelling said bullet to said target by use of a powder charge.

* * * * *